US008480435B2

(12) United States Patent
Hsiao et al.

(10) Patent No.: US 8,480,435 B2
(45) Date of Patent: Jul. 9, 2013

(54) USB CONNECTOR

(75) Inventors: Chen-Ang Hsiao, Chung Ho (TW); Wei-Kun Lee, Chung Ho (TW); Tung-Ming Chang, Chung Ho (TW); Chia-Hsin Tsai, Chung Ho (TW)

(73) Assignee: Power Quotient International Co., Ltd., Taipei (TW)

( * ) Notice: Subject to any disclaimer, the term of this patent is extended or adjusted under 35 U.S.C. 154(b) by 288 days.

(21) Appl. No.: 12/953,132

(22) Filed: Nov. 23, 2010

(65) Prior Publication Data

US 2012/0052731 A1 Mar. 1, 2012

(30) Foreign Application Priority Data

Aug. 24, 2010 (TW) ..... 99204726 U
Aug. 24, 2010 (TW) ..... 99216240 U

(51) Int. Cl.
*H01R 24/00* (2011.01)

(52) U.S. Cl.
USPC ..... 439/660

(58) Field of Classification Search
USPC ..... 439/660
See application file for complete search history.

(56) References Cited

U.S. PATENT DOCUMENTS 7,021,971 B2 * 4/2006 Chou et al. ..... 439/660
7,128,617 B2 * 10/2006 Wang et al. ..... 439/660
7,422,488 B1 * 9/2008 Wu ..... 439/676
7,442,051 B2 * 10/2008 Jiang et al. ..... 439/76.1
7,540,786 B1 * 6/2009 Koser et al. ..... 439/660
7,604,512 B1 * 10/2009 Chen ..... 439/660
7,614,920 B1 * 11/2009 Yi ..... 439/682
7,618,293 B2 * 11/2009 Wu ..... 439/660
7,628,655 B1 * 12/2009 Chen ..... 439/660
7,654,866 B2 * 2/2010 He et al. ..... 439/607.01
7,682,200 B2 * 3/2010 Zheng et al. ..... 439/660
7,695,318 B1 * 4/2010 Wang et al. ..... 439/607.01
7,717,745 B2 * 5/2010 He et al. ..... 439/607.23
7,722,407 B2 * 5/2010 Momose ..... 439/638
7,736,184 B1 * 6/2010 Wan et al. ..... 439/607.11
7,744,382 B2 * 6/2010 Zheng et al. ..... 439/79
7,758,379 B2 * 7/2010 Chen ..... 439/607.11
7,806,704 B2 * 10/2010 Miyoshi et al. ..... 439/108
7,837,510 B1 * 11/2010 Hung et al. ..... 439/660
7,850,465 B1 * 12/2010 Wan et al. ..... 439/79
7,862,346 B1 * 1/2011 Wan et al. ..... 439/79
7,883,371 B1 * 2/2011 Chen et al. ..... 439/607.41
7,909,653 B1 * 3/2011 Wan et al. ..... 439/660
7,909,654 B2 * 3/2011 He et al. ..... 439/660
7,927,145 B1 * 4/2011 Chang ..... 439/607.31
7,938,659 B1 * 5/2011 Zhu et al. ..... 439/218
7,942,704 B2 * 5/2011 Ko et al. ..... 439/660
7,946,893 B2 * 5/2011 Chen et al. ..... 439/660
7,967,641 B2 * 6/2011 Miyoshi ..... 439/660
7,972,151 B2 * 7/2011 He et al. ..... 439/108
7,988,460 B1 * 8/2011 Chiu et al. ..... 439/76.1
7,988,495 B2 * 8/2011 Chung ..... 439/660

(Continued)

*Primary Examiner* — Neil Abrams
(74) *Attorney, Agent, or Firm* — Guice Patents PLLC

(57) ABSTRACT

The present invention relates to a USB connector, comprises: a substrate on which a plurality of first contact pads and a plurality of second contact pads are installed and exposed outside the substrate; and a connector main body on which a plurality of opening slots and a plurality of terminals are installed, wherein one end of each of the terminals is respectively installed in the plural opening slots and exposed outside the opening slots, the other end thereof is respectively in contact with the second contact pads for forming a USB connector.

22 Claims, 9 Drawing Sheets

U.S. PATENT DOCUMENTS 7,988,499 B2 * 8/2011 Lin et al. ..... 439/701
8,021,195 B2 * 9/2011 He et al. ..... 439/638
8,033,841 B2 * 10/2011 He ..... 439/108
8,052,431 B1 * 11/2011 He et al. ..... 439/78
8,075,345 B2 * 12/2011 Peng ..... 439/660
8,079,854 B2 * 12/2011 He et al. ..... 439/108
8,079,879 B2 * 12/2011 Chiang ..... 439/660
8,102,657 B2 * 1/2012 Hiew et al. ..... 361/737
8,113,882 B1 * 2/2012 Chen ..... 439/607.01
8,147,276 B2 * 4/2012 Wang et al. ..... 439/660
8,152,568 B2 * 4/2012 Wu ..... 439/660
8,152,569 B2 * 4/2012 Chen et al. ..... 439/660
8,172,585 B2 * 5/2012 Chiu et al. ..... 439/108
8,182,283 B2 * 5/2012 Chang ..... 439/541.5
8,187,039 B2 * 5/2012 Tsai ..... 439/660
8,215,996 B2 * 7/2012 Su et al. ..... 439/660
8,251,747 B2 * 8/2012 He et al. ..... 439/607.28
8,267,703 B2 * 9/2012 Yao et al. ..... 439/79
8,292,671 B2 * 10/2012 Chung ..... 439/660
8,303,319 B2 * 11/2012 Yu et al. ..... 439/152
8,393,920 B2 * 3/2013 Yu et al. ..... 439/660
8,398,427 B2 * 3/2013 Wu ..... 439/497
2009/0098773 A1 * 4/2009 Cheng et al. ..... 439/607.22
2011/0244733 A1 * 10/2011 Ueda et al. ..... 439/660
2011/0281446 A1 * 11/2011 Yu et al. ..... 439/92
2012/0009811 A1 * 1/2012 He et al. ..... 439/345
2012/0052731 A1 * 3/2012 Hsiao et al. ..... 439/620.22
2012/0289089 A1 * 11/2012 Tsai et al. ..... 439/620.22

* cited by examiner

USB CONNECTOR

BACKGROUND OF THE INVENTION

1. Field of the Invention

The present invention relates to a USB connector, especially to a USB connector supporting both protocols of USB2.0 and USB3.0

2. Description of Related Art

A peripheral device having USB interfaces provides a plug-and-play function, so after relevant products are launched, the products really catch consumers attention. The USB2.0 protocol is capable of providing a transmission speed up to 480M bits/sec. With the development of multimedia technology, if a multimedia file having a volume of 25 GB is desired to be downloaded through the USB2.0 protocol, it may take quite a while and may not satisfy consumer's needs. As a result, the USB3.0 protocol is launched, the USB3.0 protocol is capable of providing a transmission speed up to 4.8 G bits/sec, if the same 25 GB multimedia file is desired to be downloaded through the USB 3.0 protocol, the required time is only one tenth of the original time that the USB2.0 protocol may take.

At present, the USB2.0 protocol is still the main stream in the market, and most peripheral devices having USB interfaces can only support the USB2.0 protocol, so how to design an electric connector capable of supporting both of the USB2.0 and USB3.0 protocols is an issue to be concerned.

With respect to the mentioned disadvantages of conventional connectors, the present invention provides a novel USB connector for improving said disadvantages.

SUMMARY OF THE INVENTION

One primary object of the present invention is to provide a USB connector having a USB2.0 connector and a USB3.0 connector having different transmission speed, for meeting the needs of transmitting with different transmission speeds.

Another object of the present invention is to provide a USB connector, having features of small volume and lower production cost.

For achieving the mentioned objects, the present invention provides a USB connector, comprises: a substrate on which a plurality of first contact pads and a plurality of second contact pads are installed and exposed outside the substrate; and a connector main body on which a plurality of opening slots and a plurality of terminals are installed, wherein one end of each of the terminals is respectively installed in the plural opening slots and exposed outside the opening slots, the other end thereof is respectively in contact with the second contact pads for forming a USB connector.

For achieving the mentioned objects, the present invention provides a USB connector, comprises: a substrate on which a plurality of first contact pads and a plurality of second contact pads are installed and exposed outside the substrate; and a connector main body having a hollow housing, the housing has a second substrate on which a plurality of third contact pads, a plurality of opening slots, a plurality of first terminals and a plurality of second terminals are installed, wherein the third contact pads are exposed outside the second substrate, so when the first substrate is inserted into the hollow housing, one end of each of the first terminals is respectively coupled to the plural third contact pads installed on the second substrate, the other end thereof is respectively coupled to the plural first contact pads installed on the first substrate, one end of each of the second terminals is in contact with the second contact pads and the other end thereof is respectively installed in the opening slots and exposed outside the opening slots for forming a USB connector.

For achieving the mentioned objects, the present invention provides a USB connector, comprises: a substrate on which a plurality of first contact pads and a plurality of second contact pads are installed and exposed outside the substrate; and a connector main body having a hollow housing, the housing has a base seat, the base seat is installed with a plurality of opening slots and a plurality of terminals, wherein the bottoms of the opening slots are hollow, and one end of each of the terminals is respectively installed in the plural opening slots and exposed outside the opening slots, the other end thereof is respectively installed at the bottoms of the opening slots, so when the substrate is inserted into the hollow housing, the plural second contact pads are in contact with the plural terminals for forming a USB connector.

For achieving the mentioned objects, the present invention provides a USB connector, comprises: a substrate on which a plurality of first contact pads and a plurality of second contact pads are installed and exposed outside the substrate, the plural first contact pads and the plural second contact pads are arranged with a staggering means; and a connector main body having a plurality of opening slots, a plurality of first terminals and a plurality of second terminals, wherein a slot column is installed between every two opening slots for separation, one end of each of the first terminals is respectively installed below the plural slot columns and exposed outside the slot columns then forwardly extended, the other end thereof is respectively coupled to the plural first contact pads; one end of each of the second terminals is respectively installed in the plural opening slots and exposed outside the opening slots, the other end thereof is respectively coupled to the plural second contact pads for forming a USB connector.

DETAILED DESCRIPTION OF THE PREFERRED EMBODIMENT

Figure 1:
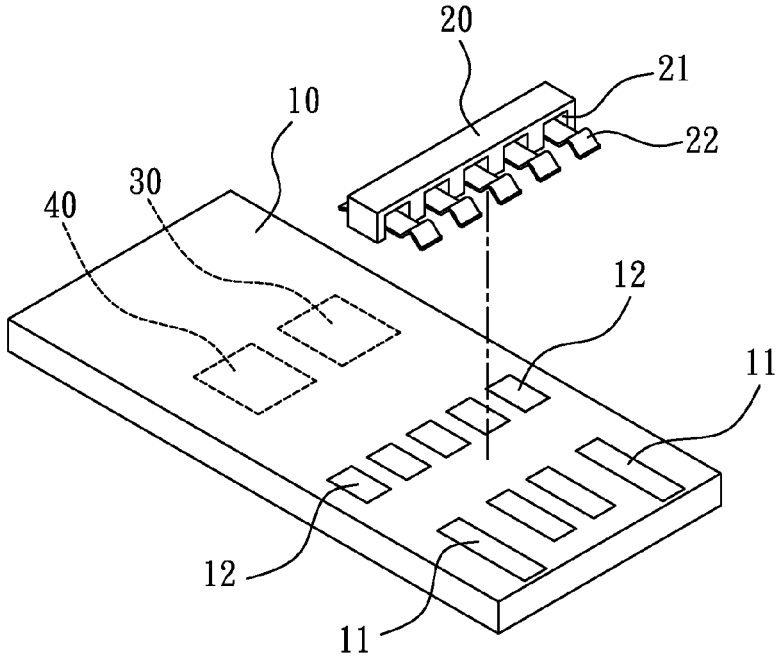
FIG. 1 is a schematic exploded view of the USB connector of one preferred embodiment of the present invention.
Figure 2:
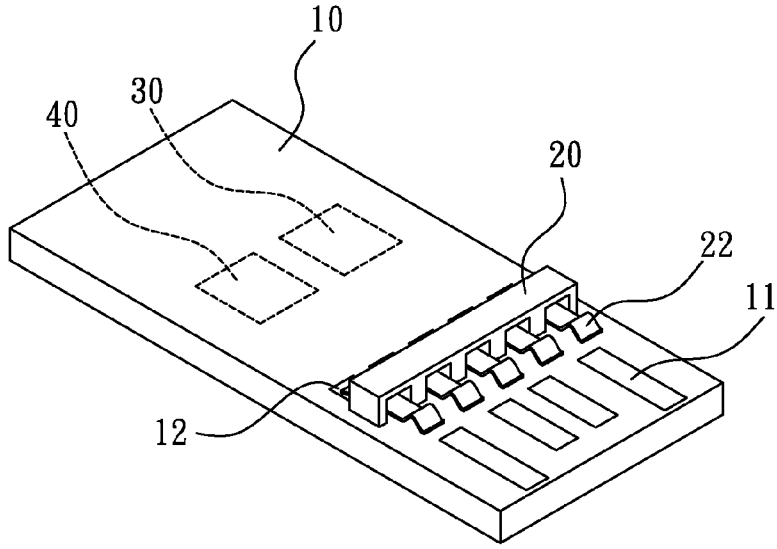
FIG. 2 is a schematic assembled view of the USB connector of one preferred embodiment of the present invention.

Referring to FIG. 1 and FIG. 2, wherein FIG. 1 is a schematic exploded view of the USB connector of one preferred embodiment of the present invention; and FIG. 2 is a schematic assembled view of the USB connector of one preferred embodiment of the present invention.

As shown in figures, the USB connector provided by the present invention comprises: a substrate 10, and a connector main body 20.

The substrate 10 is installed with a plurality of first contact pads 11 and a plurality of second contact pads 12 exposed outside the substrate 10, and the substrate 10 is a, e.g. but not limited to, Chip-On-Board (COB) substrate or printed circuit board substrate; in this embodiment of the present invention, the COB substrate is adopted for illustration and not served as a limitation. The COB technology has properties of thin thickness, compact wiring and small area, so it is widely used in the package of LCD driving chips or NAND flash memories.

The quantity of the plural first contact pads 11 is e.g. but not limited to four, so as to assemble a USB2.0 connector, wherein the plural first contact pads 11 are able to respectively transmit $V_{BUS}$, D−, D+ and GND signals of USB2.0 specification.

The plural second contact pads 12 are disposed at one side of the plural first contact pads 11, e.g. but not limited to the left side, the quantity thereof is e.g. but not limited to five, so as to assemble a USB3.0 connector, wherein the plural second contact pads 12 are able to respectively transmit StdA_SSRX−, StdA_SSRX+, GND_DRAIN, StdA_SSTX− and StdA_SSTX+ signals of USB3.0 specification.

The connector main body 20 has a plurality of opening slots 21 and a plurality of terminals 22, wherein one end of each of the plural terminals 22 is respectively installed in the plural opening slots 21 and exposed outside the opening slots 21, the other end thereof is respectively in contact with the second contact pads 12. The quantity of the plural second contact pads 12 is the same as the quantity of the plural opening slots 21, e.g. but not limited to five.

Moreover, the substrate 10 of the USB connector of the present invention is further installed with a USB controller 30 and at least one flash memory 40 respectively coupled to the plural first contact pads 11 and the plural second contact pads 12, the USB controller 30 and the flash memory 40 are installed on the substrate 10 through a means of Chip-On-Board package, said means is a conventional art and not the features of the present invention, so no further illustration is provided.

As shown in FIG. 2, when the connector main body 20 is installed on the substrate 10, the other ends of the plural terminals 22 are welded on the plural second contact pads 12 with a means of surface mount technology (SMT), so the four first contact pads 11 of the USB connector are assembled as a USB2.0 connector, the five terminals 22 of the USB connector are assembled as a USB3.0 connector, for respectively being inserted with a USB2.0 plug and a USB3.0 plug. As a result, the USB connector of the present invention has a smaller volume and lower production cost compared to conventional USB connectors.

Figure 3:
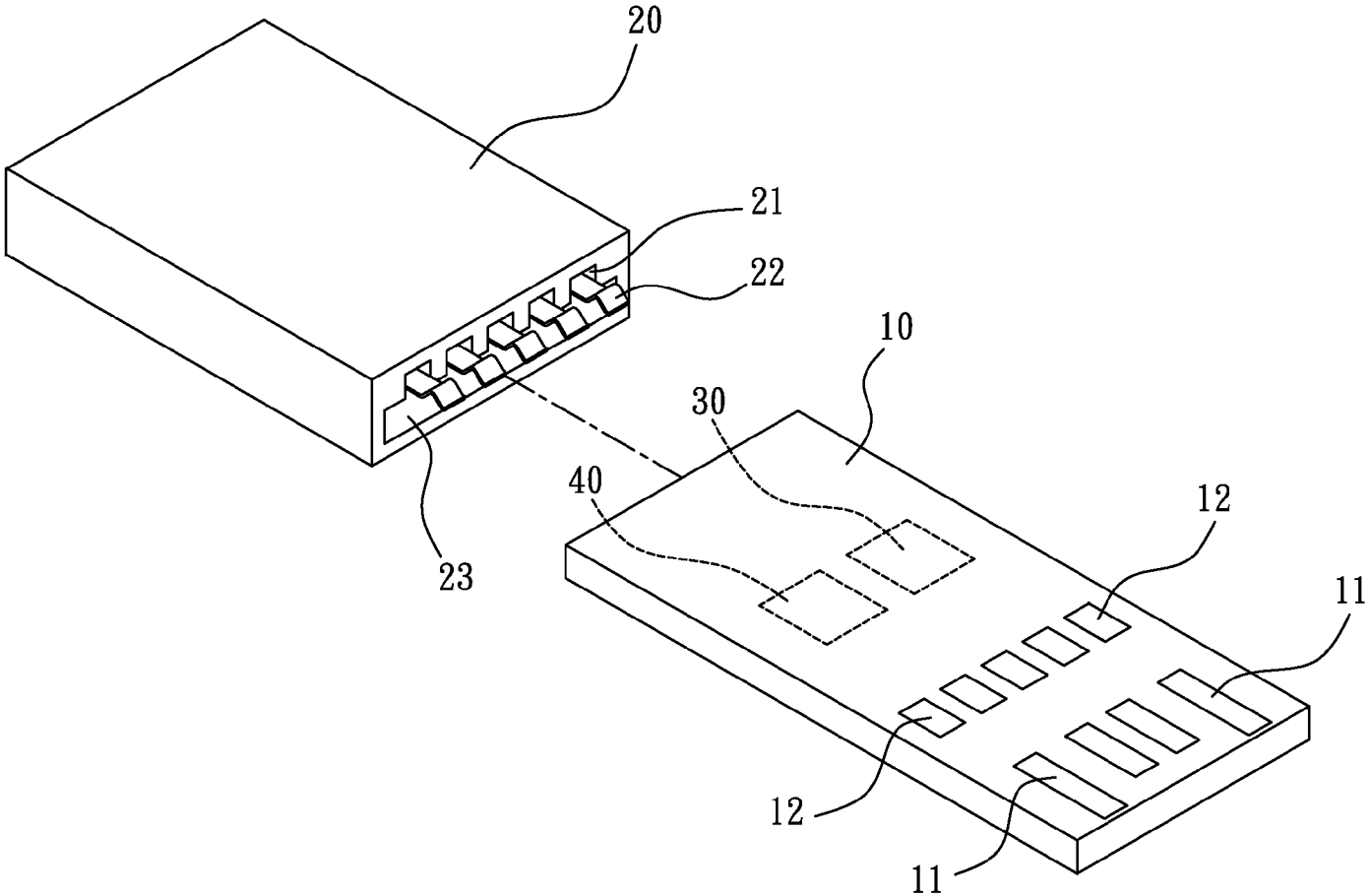
FIG. 3 is a schematic exploded view of the USB connector of another preferred embodiment of the present invention.
Figure 4A:
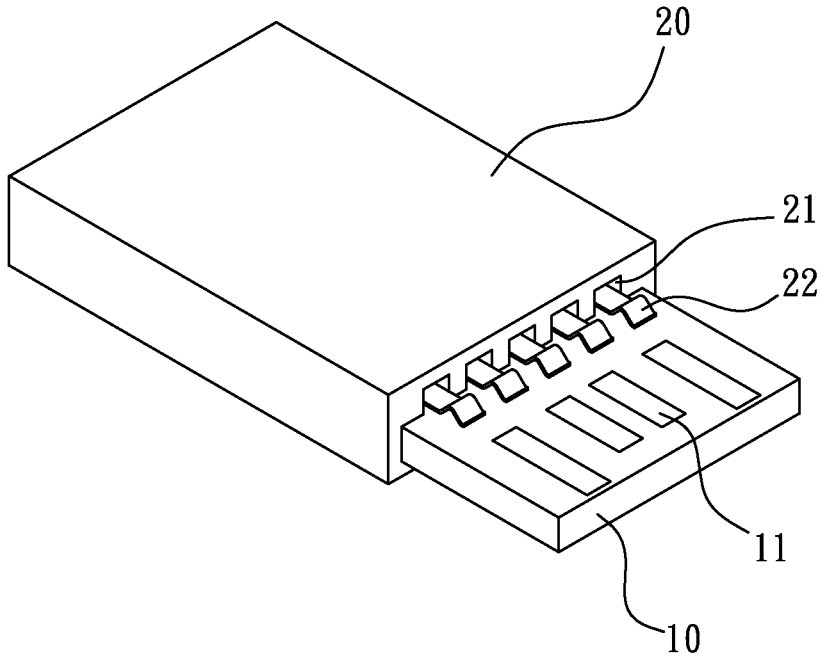
FIG. 4*a* is a schematic assembled view of the USB connector of another preferred embodiment of the present invention.
Figure 4B:
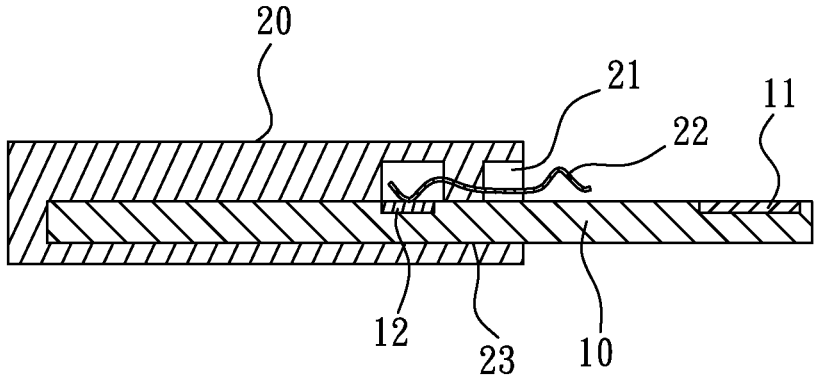
FIG. 4*b* is a schematic cross sectional view of the USB connector of another preferred embodiment of the present invention.

Referring from FIG. 3 to FIG. 4*b*, wherein FIG. 3 is a schematic exploded view of the USB connector of another preferred embodiment of the present invention; FIG. 4*a* is a schematic assembled view of the USB connector of another preferred embodiment of the present invention; and FIG. 4*b* is a schematic cross sectional view of the USB connector of another preferred embodiment of the present invention.

As shown in figures, the connector main body 20 of the USB connector of the present invention is further installed with a hollow chamber 23 having an sealed end and disposed below the plural opening slots 21, the substrate 10 is sleeved into the hollow chamber 23 and abutted against the bottom of the hollow chamber 23, such that the plural terminals 22 are disposed on top of the plural second contact pads 12 and are in contact with each other.

As shown in FIG. 4*b*, after being assembled, the plural terminals 22 and the plural second contact pads 12 are in contact with each other, so the four first contact pads 11 of the USB connector of the present invention is assembled as a USB2.0 connector, the five terminals 22 of the USB connector are assembled as a USB3.0 connector, for being respectively inserted with a USB2.0 plug and a USB3.0 plug.

Figure 5:
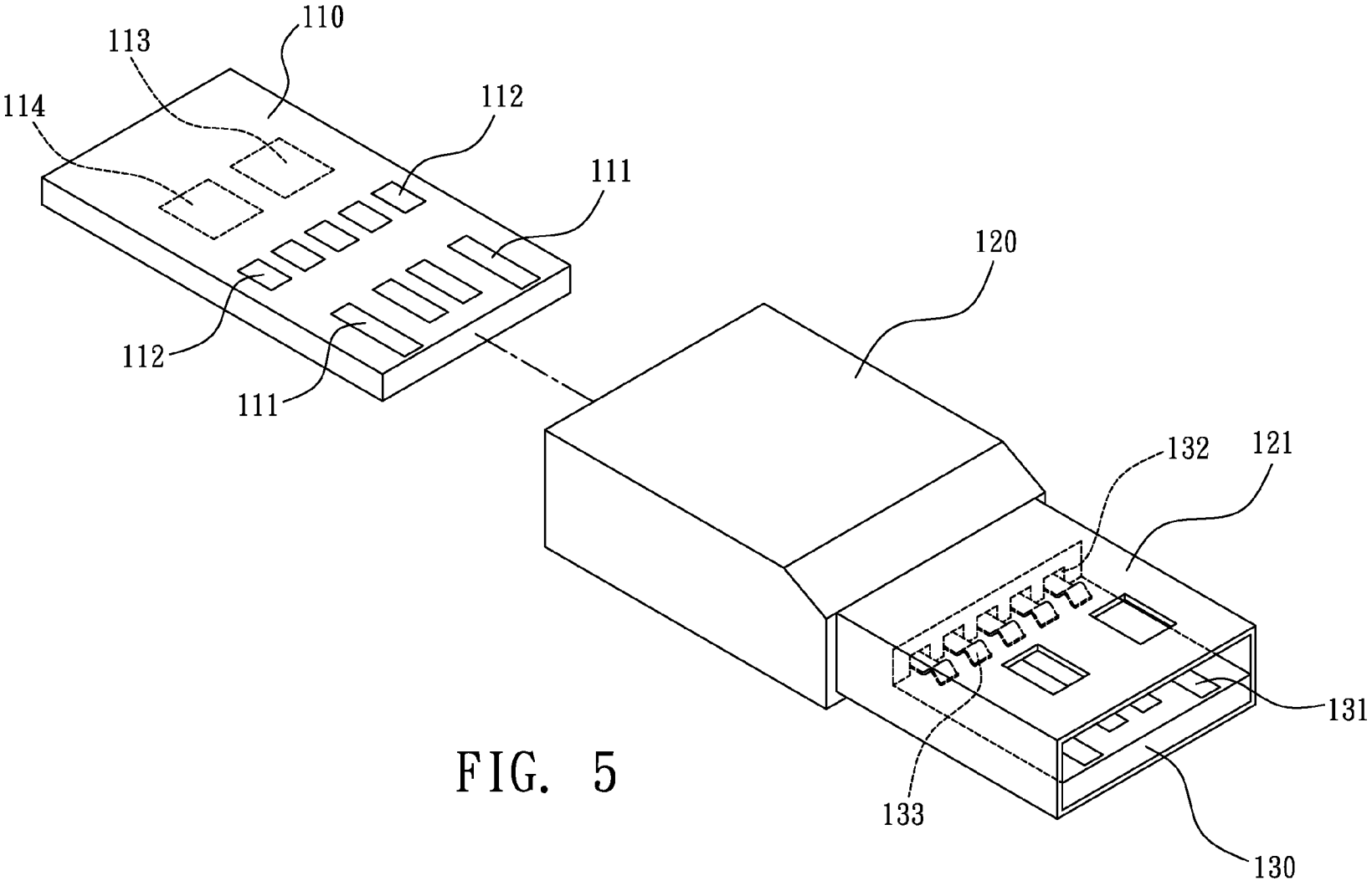
FIG. 5 is a schematic exploded view of the USB connector of one another preferred embodiment of the present invention.
Figure 6A:
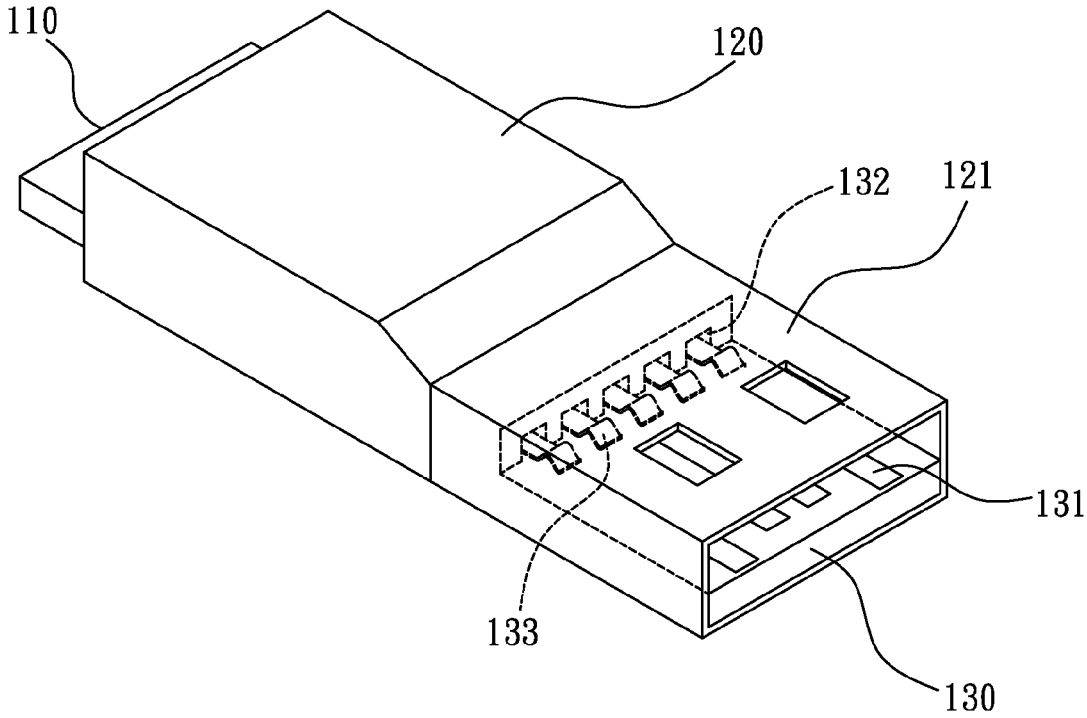
FIG. 6*a* is a schematic assembled view of the USB connector of one another preferred embodiment of the present invention.
Figure 6B:
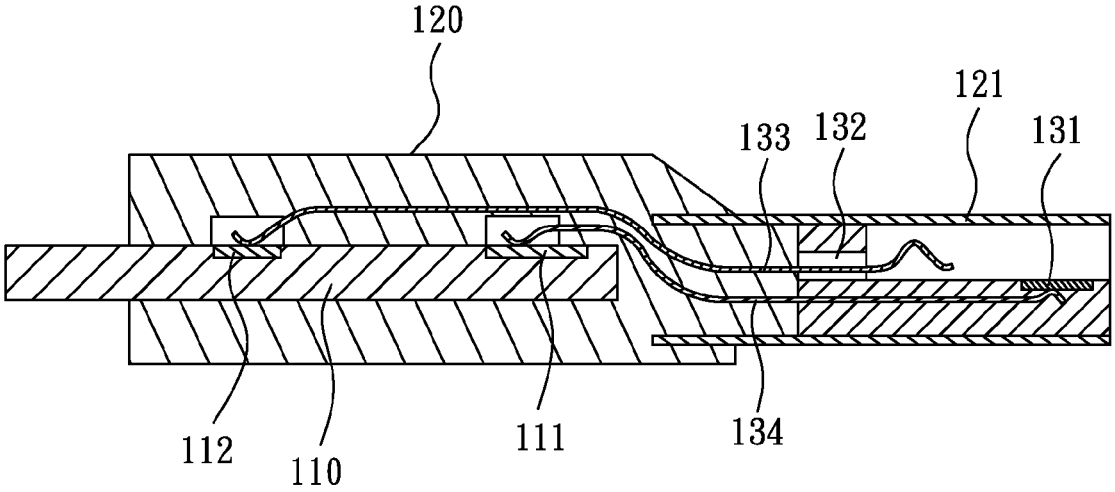
FIG. 6*b* is a schematic cross sectional view of the USB connector of one another preferred embodiment of the present invention.

Referring from FIG. 5 to FIG. 6*b*, wherein FIG. 5 is a schematic exploded view of the USB connector of one another preferred embodiment of the present invention; FIG. 6*a* is a schematic assembled view of the USB connector of one another preferred embodiment of the present invention; and FIG. 6*b* is a schematic cross sectional view of the USB connector of one another preferred embodiment of the present invention;

As shown in figures, the USB connector of another preferred embodiment of the present invention comprises a first substrate 110, and a connector main body 120.

The first substrate 110 is installed with a plurality of first contact pads 111 and a plurality of second contact pads 112 exposed outside the first substrate 110, and the first substrate 110 is a, e.g. but not limited to, Chip-On-Board (COB) substrate or printed circuit board substrate; in this embodiment of the present invention, the COB substrate is adopted for illustration and not served as a limitation. The COB technology has properties of thin thickness, compact wiring and small area, so it is widely used in the package of LCD driving chips or NAND flash memories.

The quantity of the plural first contact pads 111 is e.g. but not limited to four, so as to assemble a USB2.0 connector, wherein the plural first contact pads 111 are able to respectively transmit $V_{BUS}$, D−, D+ and GND signals of USB2.0 specification.

The plural second contact pads 112 are disposed at one side of the plural first contact pads 111, e.g. but not limited to the left side, the quantity thereof is e.g. but not limited to five, so as to assemble a USB3.0 connector, wherein the plural second contact pads 112 are able to respectively transmit StdA_SSRX−, StdA_SSRX+, GND_DRAIN, StdA_SSTX− and StdA_SSTX+ signals of USB3.0 specification.

The connector main body 120 has hollow hosing 121, the hollow housing 121 is installed with a second substrate 130; the second substrate 130 is installed with a plurality of third contact pads 131, a plurality of opening slots 132, a plurality of first terminals 133 and a plurality of second terminals 134. The plural third contact pads 131 are exposed outside the second substrate 130, and the quantity thereof is the same as the quantity of the first contact pads 111. The first substrate 110 and the second substrate 130 are a Chip-On-Board (COB) substrate or printed circuit board substrate. The quantity of the plural first contact pads 111, the quantity of the plural third contact pads 131 and the quantity of the plural first terminals 133 are four, so as to assemble a USB2.0 connector. The quantity of the second contact pads 112 and the quantity of the second terminals 134 are both five, and after being connected to the connector main body 120, a USB3.0 connector is assembled. Moreover, the front of the hollow housing 121 is a metal housing, for increasing the electromagnetic shielding effect.

The first substrate 110 of the USB connector of the present invention is further provided with a USB controller 113 and at least one flash memory 114 respectively coupled to the plural first contact pads 111 and the plural second contact pads 112; the USB controller 113 and the flash memory 114 are installed on the substrate 110 through a means of Chip-On-Board package, said means is a conventional art and not the features of the present invention, so no further illustration is provided.

As shown in FIG. 6*b*, when being assembled, the first substrate 110 is inserted into the hollow housing 121, so one end of each of the plural first terminals 133 is respectively in contact with the plural second contact pads 112, the other end thereof is respectively installed in the plural opening slots 132 and exposed outside the opening slots 132. One end of each of the plural second terminals 134 is coupled to the plural third contact pads 131 of the second substrate 130, the other end thereof is coupled to the first contact pads 111 of the first substrate 110, such that the four first contact pads 111 of the USB connector of the present invention are assembled as a USB2.0 connector, and the five first terminals 133 of the USB connector are assembled as a USB3.0 connector, for respectively being inserted with a USB2.0 plug and a USB3.0 plug. As a result, the USB connector of the present invention has a smaller volume and lower production cost compared to conventional USB connectors.

Figure 7:
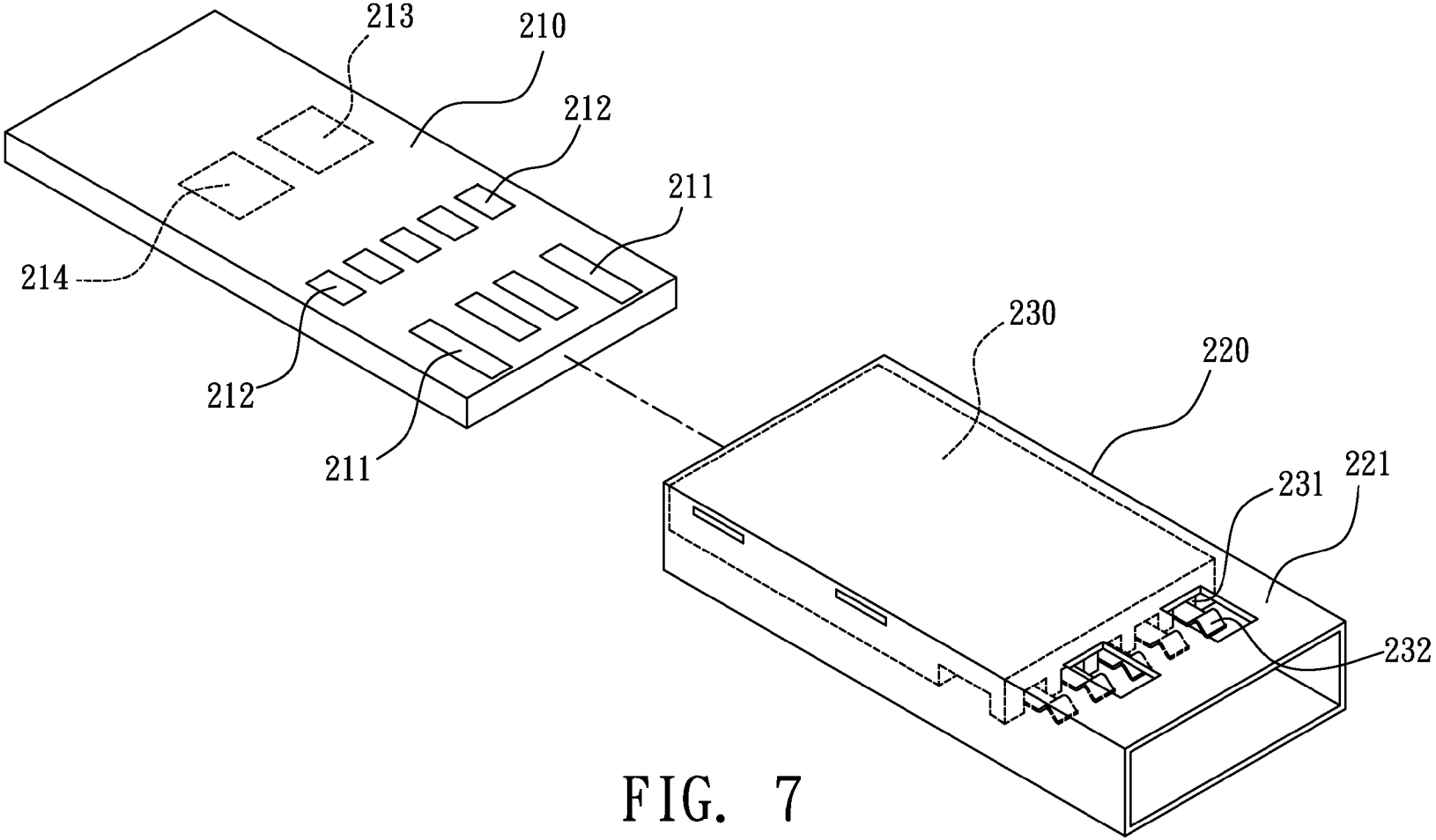
FIG. 7 is a schematic exploded view of the USB connector of still one another preferred embodiment of the present invention.
Figure 8A:
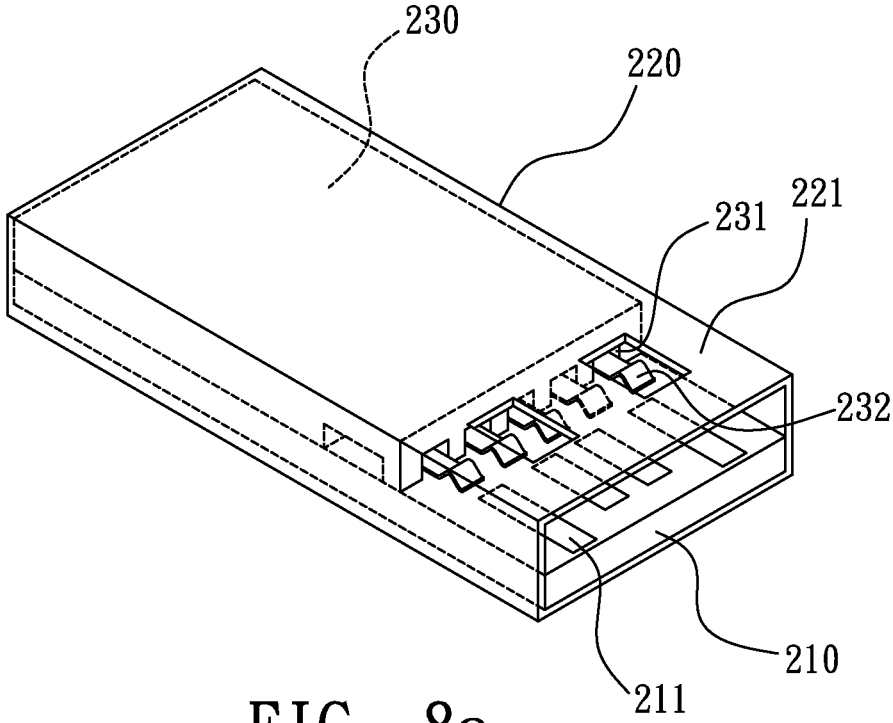
FIG. 8*a* is a schematic assembled view of the USB connector of still one another preferred embodiment of the present invention.
Figure 8B:
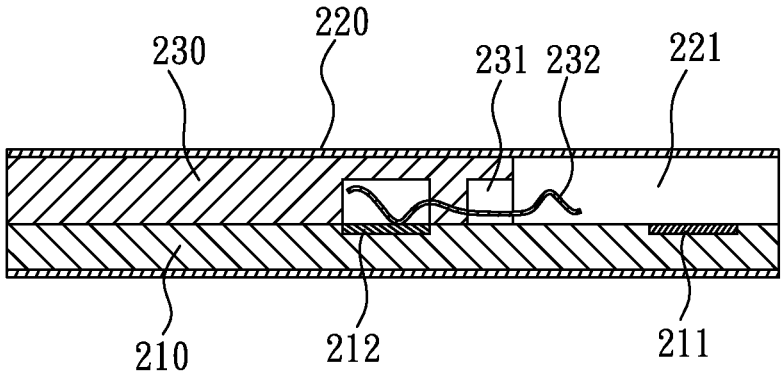
FIG. 8*b* is a schematic cross sectional view of the USB connector of still one another preferred embodiment of the present invention.

Referring from FIG. 7 to FIG. 8*b*, wherein FIG. 7 is a schematic exploded view of the USB connector of still one another preferred embodiment of the present invention; FIG. 8*a* is a schematic assembled view of the USB connector of still one another preferred embodiment of the present invention; and FIG. 8*b* is a schematic cross sectional view of the USB connector of still one another preferred embodiment of the present invention.

As shown in figures, the USB connector of still one another embodiment of the present invention comprises: a substrate 210, and a connector main body 220.

The substrate 210 is installed with a plurality of first contact pads 211 and a plurality of second contact pads 212 exposed outside the substrate 210, and the substrate 210 is a, e.g. but not limited to, Chip-On-Board (COB) substrate or printed circuit board substrate; in this embodiment of the present invention, the COB substrate is adopted for illustration and not served as a limitation. The COB technology has properties of thin thickness, compact wiring and small area, so it is widely used in the package of LCD driving chips or NAND flash memories.

The quantity of the plural first contact pads 211 is e.g. but not limited to four, so as to assemble a USB2.0 connector, wherein the plural first contact pads 211 are able to respectively transmit $V_{BUS}$, D−, D+ and GND signals of USB2.0 specification.

The plural second contact pads 212 are disposed at one side of the plural first contact pads 211, e.g. but not limited to the left side, the quantity thereof is e.g. but not limited to five, so as to assemble a USB3.0 connector, wherein the plural second contact pads 212 are able to respectively transmit StdA_SSRX−, StdA_SSRX+, GND_DRAIN, StdA_SSTX− and StdA_SSTX+ signals of USB3.0 specification.

The connector main body 220 has a hollow housing 221 having a plurality of opening slots 231 and a plurality of terminals 232. A base seat 230 is located in an upper part of an interior of the hollow housing 221. Bottoms of the opening slots 231 are hollow, and one end of each of the plural terminals 232 is respectively inserted through the plural opening slots 231 and protruding outwardly from the opening slots 231, the other end thereof is connected with a corresponding second contact pad of the plurality of second contact pads 212. The quantity of the plural first contact pads 211 is four, so as to assemble a USB2.0 connector; the quantity of the plural second contact pads 212, the quantity of the plural opening slots 231 and the quantity of the plural terminals 232 are all five, after being connected to the connector main body 220, a USB3.0 connector is assembled.

The substrate 210 of the USB connector of the present invention is further installed with a USB controller 213 and at least one flash memory 214 respectively coupled to the plural first contact pads 211 and the plural second contact pads 212; the USB controller 213 and the flash memory 214 are installed on the substrate 210 through a means of Chip-On-Board package, said means is a conventional art and not the features of the present invention, so no further illustration is provided.

As shown in FIG. 8*b*, when being assembled, the substrate 210 is inserted into the hollow housing 221, so the plural terminals 232 are in contact with the second contact pads 212 so as to form a USB connector, such that the four first contact pads 211 of the USB connector of the present invention are assembled as USB2.0 connector, and the five terminals 232 of the USB connector are assembled as a USB3.0 connector, for respectively being inserted with a USB2.0 plug and a USB3.0 plug. As a result, the USB connector of the present invention has a smaller volume and lower production cost compared to conventional USB connectors.

Figure 9:
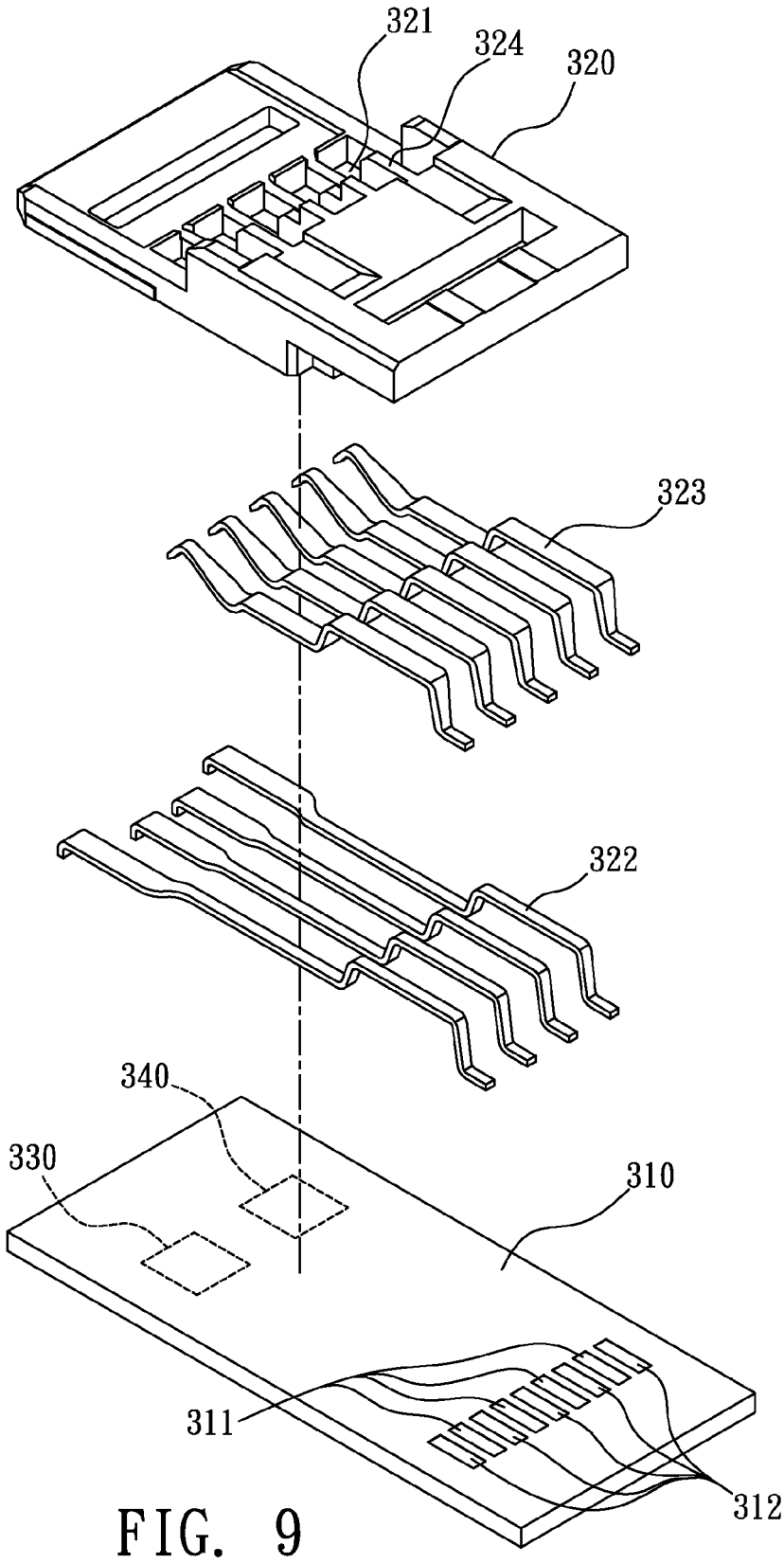
FIG. 9 is a schematic exploded view of the USB connector of still one another preferred embodiment of the present invention.
Figure 10:
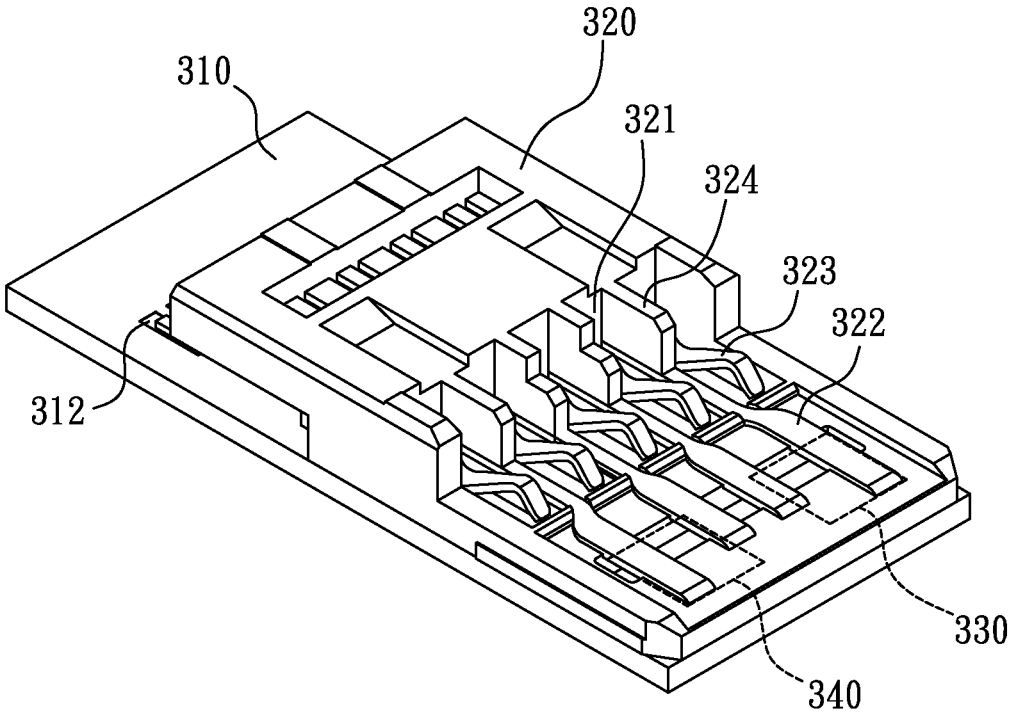
FIG. 10 is a schematic assembled view of the USB connector of still one another preferred embodiment of the present invention.

As shown in FIG. 9 and FIG. 10, wherein FIG. 9 is a schematic exploded view of the USB connector of still one another preferred embodiment of the present invention; and FIG. 10 is a schematic assembled view of the USB connector of still one another preferred embodiment of the present invention.

As shown in figures, the USB connector provided by the present invention comprises: a substrate 310, and a connector main body 320.

The substrate 310 is installed with a plurality of first contact pads 311 and a plurality of second contact pads 312 exposed outside the substrate 310, and the plural first contact pads 311 and the plural second contact pads 312 are arranged with e.g. but not limited to a staggering means. Moreover, the substrate 310 is a, e.g. but not limited to, Chip-On-Board (COB) substrate or printed circuit board substrate; in this embodiment of the present invention, the COB substrate is adopted for illustration and not served as a limitation. The COB technology has properties of thin thickness, compact wiring and small area, so it is widely used in the package of LCD driving chips or NAND flash memories.

The quantity of the plural first contact pads 311 is e.g. but not limited to four, so as to assemble a USB2.0 connector, wherein the plural first contact pads 311 are able to respectively transmit $V_{BUS}$, D−, D+ and GND signals of USB2.0 specification.

The plural second contact pads 312 and the plural first contact pads 311 are arranged with e.g. but not limited to a staggering means; the quantity thereof is e.g. but not limited to five, wherein the plural second contact pads 312 are able to respectively transmit StdA_SSRX−, StdA_SSRX+, GND_DRAIN, StdA_SSTX− and StdA_SSTX+ signals of USB3.0 specification.

The connector main body 320 is made of insulation material, e.g. but not limited to plastic, and is installed with a plurality of opening slots 321, a plurality of first terminals 322 and a plurality of second terminals 323, wherein a slot column 324 is located between every two opening slots 321 separating two adjacent opening slots of said plurality of opening slots 321. One end of each of the first terminals 322, e.g. but not limited to the right side, is respectively installed below the plural slot columns 324 and exposed outside the slot columns 324 then forwardly extended, the other end thereof, e.g. but not limited to the left side, is respectively coupled to the plural first contact pads 311. The quantity of the plural first terminals 322 and the quantity of the plural slot columns 324 are the same, e.g. but not limited to four.

One end of each of the second terminals 323, e.g. but not limited to the right side, is respectively installed in the plural opening slots 321 and exposed outside the opening slots 321, the other end thereof, e.g. but not limited to the left side, is respectively coupled to the plural second contact pads 312 for forming the USB connector of the present invention. The quantity of the plural second terminals 323 and the quantity of the plural opening slots 321 are the same, e.g. but not limited to five.

Moreover, one end of each of the second terminals 323 is further upwardly bended then downwardly bended after being exposed outside the opening slots 321.

The substrate 310 of the USB connector of the present invention is further installed with a USB controller 330 and at least one flash memory 340 respectively coupled to the plural first contact pads 311 and the plural second contact pads 312; the USB controller 330 and the flash memory 340 are installed on the substrate 310 through a means of Chip-On-Board package, said means is a conventional art and not the features of the present invention, so no further illustration is provided.

As shown in FIG. 10, when being manufactured, firstly the plural first terminals 322 and the plural second terminals 323 are arranged with a staggering means, then is integrally formed with the connector main body 320; then the connector main body 320 is disposed on the substrate 310, and the other ends of the plural first terminals 322 and the plural second terminals 323 are respectively welded on the plural first contact pads 311 and the plural second contact pads 312 with a means of surface mount technology (SMT). As such, the four first terminals 322 of the USB connector are assembled as a USB2.0 connector, the five second terminals 323 of the USB connector are assembled as a USB3.0 connector, for respectively being inserted with a USB2.0 plug and a USB3.0 plug. As a result, the USB connector of the present invention has a smaller volume and lower production cost compared to conventional USB connectors.

As what is mentioned above, the USB connector of the present invention has a USB2.0 connector and a USB3.0 connector having different transmission speed, for meeting the needs of USB connector having different transmission speed; and the USB connector of the present invention has a smaller volume and lower production cost compared to conventional USB connectors. Therefore the USB connector provided by the present invention is novel compared to conventional USB connectors.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A USB connector, comprising:

a substrate on which a plurality of first contact pads and a plurality of second contact pads being installed and exposed outside said substrate; and a connector main body having a plurality of opening slots, a hollow chamber having an sealed end and communicating with the plurality of opening slots, and a plurality of terminals inserted into the plurality of opening slots, said hollow chamber is located below said plurality of opening slots of said connector main body, a first end of said substrate is inserted into said hollow chamber and abutted against the sealed end of said hollow chamber and said plurality of second contact pads are located in said hollow chamber of said connector body and positioned directly below a corresponding slot of said plurality of opening slots, a first end of each of said plurality of terminals is respectively inserted into each said corresponding slot of said plurality of opening slots and located on top of and contacting a corresponding second contact pad of the plurality of second contact pads and a second end of said plurality of plurality of terminals extending outwardly from said connector main body, said hollow chamber and said plurality of opening slots of said connector main body are integrally made;

wherein each of said plurality of terminals is located entirely on a top surface of said substrate.

2. The USB connector as claimed in claim 1, wherein said substrate is selected from a group consisting of a chip-on-board (COB) substrate and printed circuit board substrate.

3. The USB connector as claimed in claim 1, wherein the quantity of said plurality first contact pads is four, so as to assemble a USB 2.0 connector; the quantity of said plurality of second contact pads and the quantity of said plurality of opening slots are both five, after being connected with said connector main body, a USB3.0 connector is assembled.

4. The USB connector as claimed in claim 1, wherein said substrate is further installed with a USB controller and at least one flash memory respectively coupled to said plurality of first contact pads and said plurality second contact pads.

5. The USB connector as claimed in claim 1, wherein said plurality of terminals of said connector main body are welded on said plurality of second contact pads with a means of surface mount technology (SMT).

6. A USB connector, comprising:

a first substrate on which a plurality of first contact pads and a plurality of second contact pads being installed and exposed outside said first substrate; and a connector main body having a hollow housing, said housing having a second substrate on which a plurality of third contact pads, a plurality of opening slots, a plurality of first terminals and a plurality of second terminals being installed, wherein said third contact pads being exposed outside said second substrate, so when said first substrate being inserted into said hollow housing, one end of each of said second terminals being respectively coupled to said plurality third contact pads installed on said second substrate, the other end thereof being respectively coupled to said plurality of first contact pads installed on said first substrate, one end of each of said first terminals being in contact with said second contact pads and the other end thereof being respectively installed in said opening slots and exposed outside said opening slots for forming said USB connector.

7. The USB connector as claimed in claim 6, wherein said first substrate and said second substrate are selected from a group consisting of a chip-on-board (COB) substrate and printed circuit board substrate.

8. The USB connector as claimed in claim 6, wherein the quantity of said plurality of first contact pads, the quantity of said third contact pads and the quantity of said first terminals are all four, so as to assemble a USB 2.0 connector; the quantity of said plurality of second contact pads and the quantity of said plurality of second terminals are both five, after being connected with said connector main body, a USB3.0 connector is assembled.

9. The USB connector as claimed in claim 6, wherein said first substrate is further installed with a USB controller and at least one flash memory respectively coupled to said plurality of first contact pads and said plurality of second contact pads.

10. The USB connector as claimed in claim 6, wherein the front of said hollow housing is a metal housing, for increasing the electromagnetic shielding effect.

11. A USB connector, comprising:

a substrate having a plurality of first contact pads and a plurality of second contact pads installed and exposed outside said substrate; and a connector main body having a hollow housing, said hollow housing having a base seat, said base seat located in an upper part of an interior of the hollow housing and having a plurality of opening slots and a plurality of terminals, wherein bottoms of said plurality of opening slots being hollow, and a first end of each of said plurality of terminals is respectively inserted into each said corresponding slot of said plurality of opening slots and located at the bottom of said corresponding slot and a second end of said plurality of plurality of terminals extending outwardly from said opening slots into said hollow housing of said connector main body, when said substrate being inserted into said hollow housing, said plurality of second contact pads being in contact with said plurality of terminals for forming said USB connector;

wherein each of said plurality of terminals is located entirely on a top surface of said substrate;

wherein a first end of said substrate and a first end of said base seat aligning with a first end of said connector body and a second end of said substrate aligning with a second end of said connector body, a second end of said base seat is located in said hollow housing between said plurality of first contact pads and said plurality of second contact pads of said substrate.

12. The USB connector as claimed in claim 11, wherein said substrate is selected from a group consisting of a chip-on-board (COB) substrate and printed circuit board substrate.

13. The USB connector as claimed in claim 11, wherein the quantity of said plurality first contact pads is four, so as to assemble a USB 2.0 connector; the quantity of said plurality of second contact pads, the quantity of said plurality of opening slots and the quantity of said plurality of terminals are all five, after being connected with said connector main body, a USB3.0 connector is assembled.

14. The USB connector as claimed in claim 11, wherein said substrate is further installed with a USB controller and at least one flash memory respectively coupled to said plurality of first contact pads and said plurality of second contact pads.

15. The USB connector as claimed in claim 11, wherein the front of said hollow housing is a metal housing for increasing the electromagnetic shielding effect.

16. A USB connector, comprising:

a substrate having a plurality of first contact pads and a plurality of second contact pads being installed, said plurality of first contact pads and said plurality second contact pads are alternatingly arranged in a single row and two second contact pads of the plurality of second contact pads are respectively located at opposing ends of the single row; and a connector main body having a plurality of opening slots, a plurality of first terminals and a plurality of second terminals, wherein a slot column being located between two adjacent opening slots of said plurality of opening slots separating said two adjacent opening slots, a first end of each of said first terminals being respectively located below said plurality of slot columns and exposed outside said slot columns then forwardly extended, a second end of each of said first terminals being respectively coupled to said plurality of first contact pads, a first end of each of said second terminals being respectively installed in said plurality of opening slots and exposed outside said opening slots, and a second end of each of said second terminals being respectively coupled to said plurality of second contact pads for forming said USB connector;

wherein each of said plurality of first terminals and said plurality of second terminals are located entirely on a top surface of said substrate.

17. The USB connector as claimed in claim 16, wherein said substrate is selected from a group consisting of a chip-on-board (COB) substrate and printed circuit board substrate.

18. The USB connector as claimed in claim 16, wherein the quantity of said plurality first contact pads and the quantity of said plurality of first terminals are both four, so as to assemble a USB 2.0 connector; the quantity of said plurality of second contact pads, the quantity of said plurality of opening slots and the quantity of said plurality of second terminals are all five, after being combined, a USB3.0 connector is assembled.

19. The USB connector as claimed in claim 16, wherein said substrate is further installed with a USB controller and at least one flash memory respectively coupled to said plurality of first contact pads and said plurality of second contact pads.

20. The USB connector as claimed in claim 16, wherein said plurality of first terminals and said plurality of second terminals of said connector main body are respectively welded on said plurality of first contact pads and said plurality of second contact pads with a means of surface mount technology (SMT).

21. The USB connector as claimed in claim 16, wherein one end of each of said second terminals is further upwardly bended then downwardly bended after being exposed outside said opening slots.

22. The USB connector as claimed in claim 16, wherein said connector main body, said plurality of first terminals and said plurality of second terminals are integrally formed.

* * * * *

UNITED STATES PATENT AND TRADEMARK OFFICE

CERTIFICATE OF CORRECTION

PATENT NO. : 8,480,435 B2
APPLICATION NO. : 12/953132
DATED : July 9, 2013
INVENTOR(S) : Chen-Ang Hsiao et al.

It is certified that error appears in the above-identified patent and that said Letters Patent is hereby corrected as shown below:

On the title page, item (30) should read as follows:

--(30) Foreign Application Priority Data

Mar. 18, 2010 (TW) ..... 99204726 U
Aug. 24, 2010 (TW) ..... 99216240 U--

Signed and Sealed this
Sixth Day of August, 2013

Teresa Stanek Rea
*Acting Director of the United States Patent and Trademark Office*